US008781146B2

(12) United States Patent
Haymond

(10) Patent No.: US 8,781,146 B2
(45) Date of Patent: Jul. 15, 2014

(54) COMBINED PASSIVE ACOUSTIC SPEAKER AND STAND

(71) Applicant: American Covers, Inc., Draper, UT (US)

(72) Inventor: Bryce Haymond, Pleasant Grove, UT (US)

(73) Assignee: American Covers, Inc., Draper, UT (US)

( * ) Notice: Subject to any disclaimer, the term of this patent is extended or adjusted under 35 U.S.C. 154(b) by 0 days.

(21) Appl. No.: 13/793,725

(22) Filed: Mar. 11, 2013

(65) Prior Publication Data

US 2014/0161294 A1 Jun. 12, 2014

Related U.S. Application Data

(60) Provisional application No. 61/735,855, filed on Dec. 11, 2012.

(51) Int. Cl.
*H04R 1/20* (2006.01)
*H04R 9/06* (2006.01)

(52) U.S. Cl.
USPC ..... 381/341; 381/336

(58) Field of Classification Search
USPC ..... 381/338, 340; 379/325–330
See application file for complete search history.

(56) References Cited

U.S. PATENT DOCUMENTS

| | | | |
|---|---|---|---|
| D221,045 | S | 7/1971 | McCabe et al. |
| 3,618,698 | A | 11/1971 | McCabe et al. |
| D266,945 | S | 11/1982 | Greenberg |
| 4,574,912 | A | 3/1986 | Fuss et al. |
| D310,530 | S | 9/1990 | McGuire |
| D330,415 | S | 10/1992 | Thomas |
| D330,588 | S | 10/1992 | Lindeen |
| D375,909 | S | 11/1996 | Dziersk et al. |
| D397,118 | S | 8/1998 | Keating |
| D416,559 | S | 11/1999 | Hoyt et al. |
| D456,811 | S | 5/2002 | Wheelock et al. |
| D456,901 | S | 5/2002 | Dudziak |
| D515,585 | S | 2/2006 | Landau |

(Continued)

OTHER PUBLICATIONS http://dx.com/p/egg-shaped-silicone-stand-audio-amplifier-for-iphone-4-4s-black-125332; printed Oct. 31, 2012.

(Continued)

*Primary Examiner* — Brian Ensey
*Assistant Examiner* — Norman Yu
(74) *Attorney, Agent, or Firm* — Thorpe North & Western LLP

(57) ABSTRACT

A combined passive acoustic speaker and stand for a portable, handheld electronic device includes a block with an inclined slot in the side oriented at an acute angle with respect to a bottom of the block to receive and retain a portion of the portable, handheld electronic device therein at an acute inclined angle with respect to a support surface. An aperture in the bottom of the slot extends through the side of the block and into a hollow therein. The hollow includes a non-symmetrical, arcuate-axis, frusto-conical horn with a larger forward sound outlet opening in the front of the block and a smaller rearward sound inlet opening in a rear of the horn open to the aperture in the bottom of the slot.

21 Claims, 5 Drawing Sheets

(56) References Cited

U.S. PATENT DOCUMENTS

| | | | | |
|---|---|---|---|---|
| 8,220,585 | B2 | 7/2012 | Vogel | |
| 8,320,597 | B2 * | 11/2012 | Griffin et al. | 381/339 |
| D674,492 | S | 1/2013 | Vogel | |
| 2005/0178610 | A1 | 8/2005 | Broersma | |
| 2013/0170686 | A1 * | 7/2013 | Lester, Jr. | 381/338 |

OTHER PUBLICATIONS http://firewireblog.com/2010/10/23/bone-iphone-horn-stand; printed Oct. 31, 2012.

U.S. Appl. No. 29/439,465, filed Dec. 11, 2012, Bryce Haymond; notice of allowance dated Apr. 2, 2013.

* cited by examiner

COMBINED PASSIVE ACOUSTIC SPEAKER AND STAND

PRIORITY CLAIM(S)

Priority is claimed to U.S. Provisional Patent Application Ser. No. 61/735,855, filed Dec. 11, 2012, which is hereby incorporated herein by reference.

RELATED APPLICATION(S)

This is related to U.S. Design Patent Application No. 29/439,465, filed Dec. 11, 2012, which is hereby incorporated herein by reference.

BACKGROUND

1. Field of the Invention

The present invention relates generally to a passive speaker amplifier for portable, handheld electronic devices, such as cellular phones or smart phones.

2. Related Art

Cellular phones and the like have become increasing popular devices to watch media, surf the internet, etc. Such devices typically have a headphone jack to receive a headphone plug associated with a user's personal headphone, earphone, or earbud. The devices can also have a small speaker. Often, users find that the typical earbuds can be uncomfortable to wear for extended periods, and that small speaker is inadequate for easy listening.

Various passive sound amplifiers have been proposed in which the cellular phone is perched precariously atop the amplifier, such as with a horn or egg shape, with the cellular phone in a near vertical orientation. For example, see the Bone brand horn stand.

SUMMARY OF THE INVENTION

It has been recognized that it would be advantageous to develop a passive, acoustic speaker amplifier for a portable, handheld electronic device, such as a cellular or smart phone, that optimizes viewing angle. In addition, it has been recognized that it would be advantageous to develop a passive, acoustic speaker amplifier capable of stabilizing and/or supporting a portable, handheld electronic device in a stable manner.

The invention provides a combined passive acoustic speaker and stand device for a portable, handheld electronic device. The combined passive acoustic speaker and stand device includes a block having a hollow therein, a bottom disposable on a support surface, a front facing forward, a top facing upward, and a side facing laterally with respect to the front. An inclined slot is in the side and oriented at an acute angle with respect to the bottom. The includes slot has a slot bottom and slot sides forming an elongated channel in the side of the block to receive and releasably retain a portion of the portable, handheld electronic device therein at an acute inclined angle with respect to the support surface. An aperture is in the bottom of the slot and extends through the side of the block and into the hollow therein. The aperture is located to align with a speaker of the portable, handheld electronic device when inserted into the slot. The hollow is shaped as a non-symmetrical, arcuate-axis, frusto-conical horn with a larger forward sound outlet opening in the front of the block and a smaller rearward sound inlet opening in a rear of the horn and open to the aperture in the bottom of the slot.

In addition, the invention provides a combined passive acoustic speaker and stand device in combination with a portable, handheld electronic device with a speaker in an edge thereof. The combined passive acoustic speaker and stand device includes a block having a hollow therein, a bottom disposable on a support surface, a front facing forward, a top facing upward, and a side facing laterally with respect to the front. An inclined slot is in the side and oriented at an acute angle with respect to the bottom. The slot has a slot bottom and slot sides forming an elongated channel in the side of the block removably receiving and retaining a portion of the portable, handheld electronic device therein at an acute inclined angle with respect to the support surface. An aperture is in the bottom of the slot and extends through the side of the block and into the hollow therein. The aperture is aligned with the speaker of the portable, handheld electronic device when inserted into the slot. The hollow includes a non-symmetrical, arcuate-axis, frusto-conical horn with a larger forward sound outlet opening in the front of the block and a smaller rearward sound inlet opening in a rear of the horn and open to the aperture in the bottom of the slot. An upper indentation is in the top of the block. An insert is disposed in the upper indentation with an upper surface extending above the block. Indicia is carried by the insert or the block at the indentation.

Furthermore, the invention provides a combined passive acoustic speaker and stand device, in combination with a portable, handheld electronic device with a speaker in an edge thereof. The combined passive acoustic speaker and stand device includes a block having a hollow therein, a bottom disposable on a support surface, a front facing forward, a top facing upward, and a side facing laterally with respect to the front. An inclined slot is in the side and oriented at an acute angle between 50 and 70 degrees with respect to the bottom. The slot has a slot bottom and slot sides forming an elongated channel in the side of the block removably receiving and retaining a portion of the portable, handheld electronic device therein at the acute inclined angle with respect to the support surface. The slot has an open end with the block and the portable, handheld electronic device both resting on the support surface when the portable, handheld electronic device is inserted into the slot with a side edge of the portable, handheld electronic device contacting the support surface along an entire length of the side edge. The slot sides are formed of a flexible and resilient material capable of deflecting outwardly to grip the portable, handheld electronic device. The slot sides are tapered and the channel has a narrower outer opening and a wider bottom. An aperture is in the bottom of the slot and extends through the side of the block and into the hollow therein. The aperture is aligned with the speaker of the portable, handheld electronic device when inserted into the slot. The hollow includes a non-symmetrical, arcuate-axis, frusto-conical horn with a larger forward sound outlet opening in the front of the block and a smaller rearward sound inlet opening in a rear of the horn and open to the aperture in the bottom of the slot. An upper indentation is in the top of the block. An insert is disposed in the upper indentation with an upper surface extending above the block. Indicia is carried by the insert or the block at the indentation.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
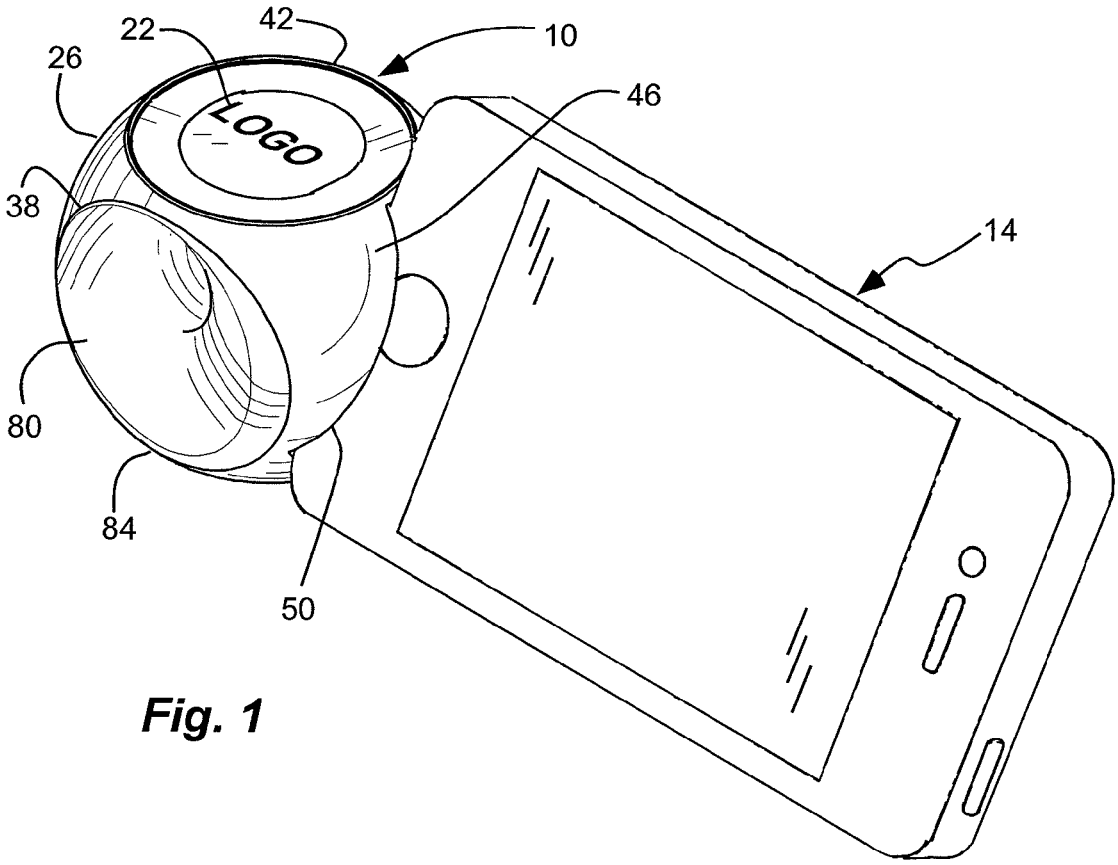
FIG. 1 is a perspective view of a combined passive acoustic speaker and stand device in accordance with an embodiment of the present invention shown supporting and amplifying a portable, handheld electronic device.
Figure 2:
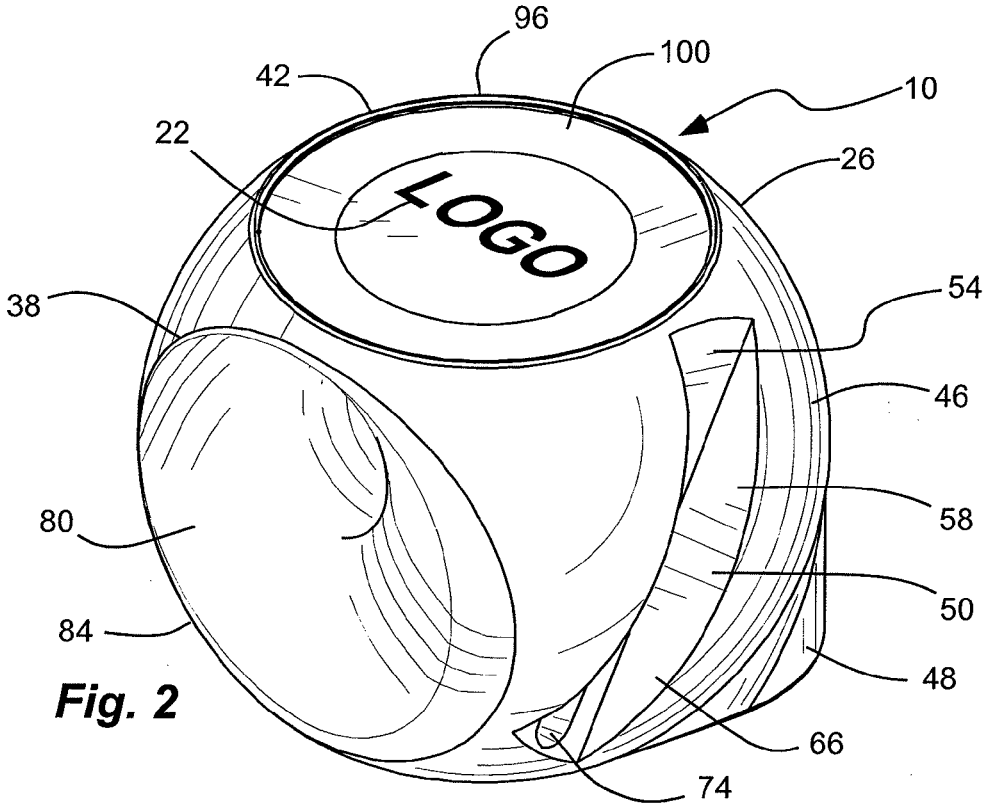
FIG. 2 is a perspective view of the combined passive acoustic speaker and stand device of FIG. 1.
Figure 3:
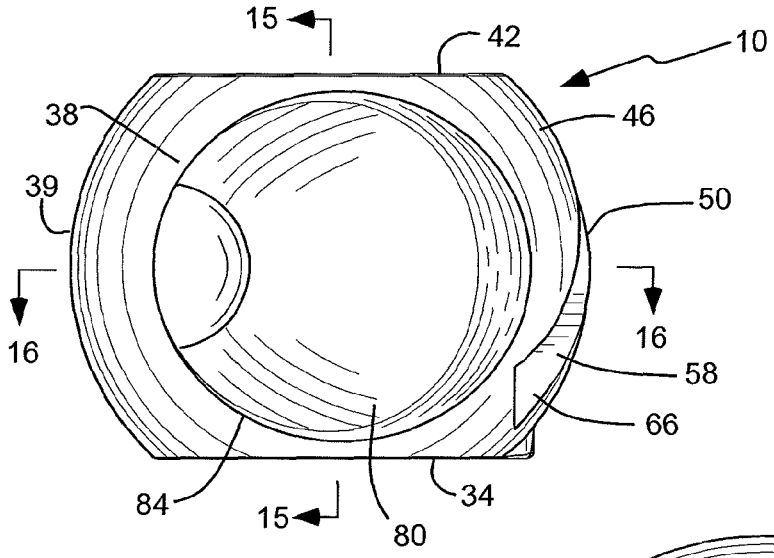
FIG. 3 is a front view of the combined passive acoustic speaker and stand device of FIG. 1.
Figure 4:
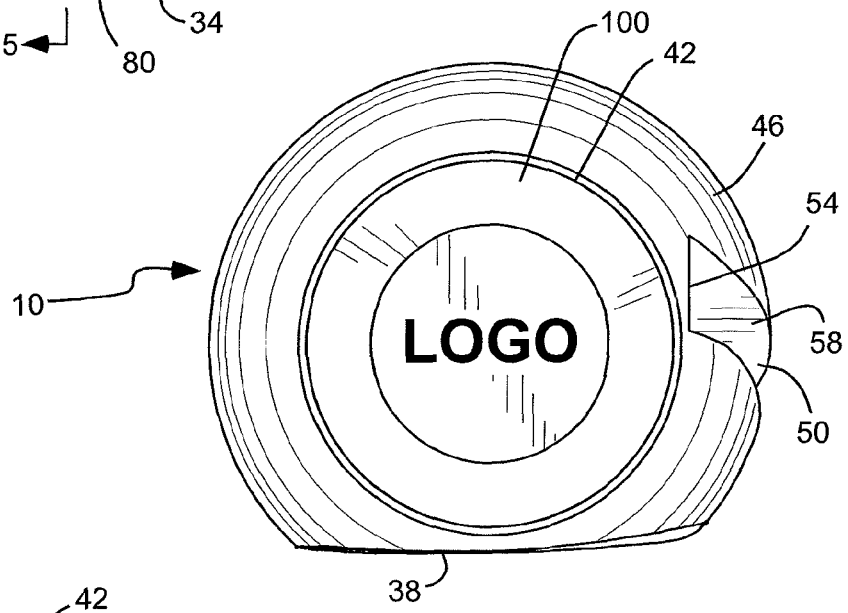
FIG. 4 is a top view of the combined passive acoustic speaker and stand device of FIG. 1.
Figure 5:
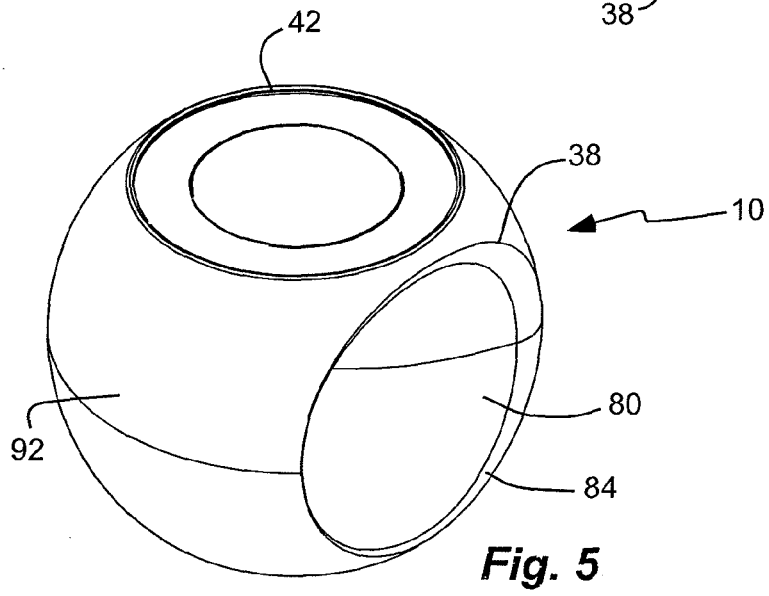
FIG. 5 is a perspective view of the combined passive acoustic speaker and stand device of FIG. 1.
Figure 6:
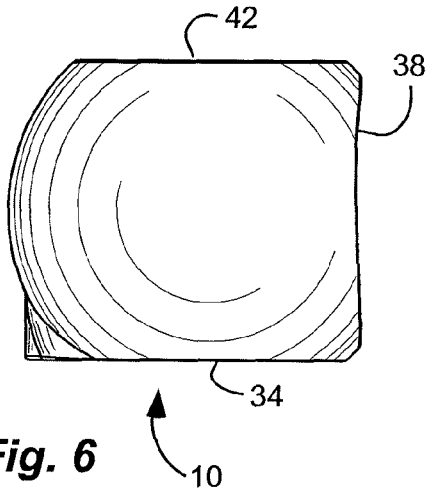
FIG. 6 is a side view of the combined passive acoustic speaker and stand device of FIG. 1.
Figure 7:
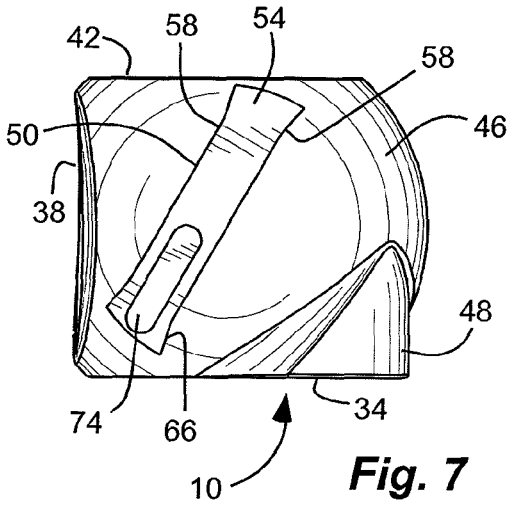
FIG. 7 is an opposite side view of the combined passive acoustic speaker and stand device of FIG. 1.
Figure 8:
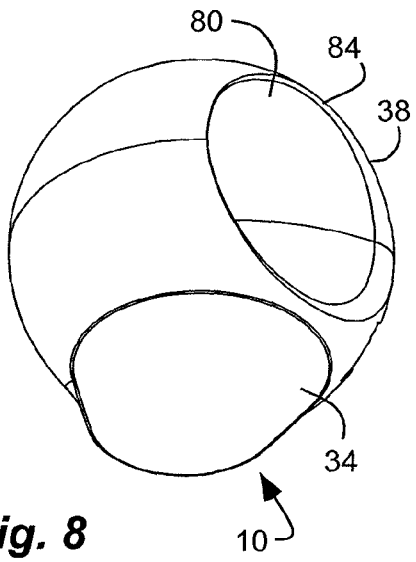
FIG. 8 is a bottom perspective view of the combined passive acoustic speaker and stand device of FIG. 1.
Figure 9:
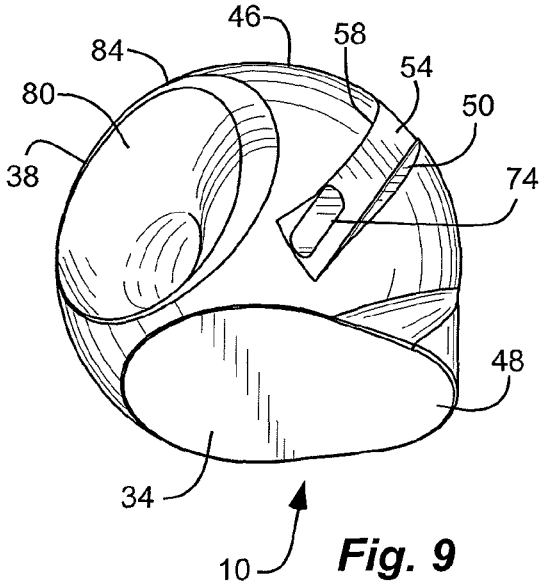
FIG. 9 is a bottom perspective view of the combined passive acoustic speaker and stand device of FIG. 1.
Figure 10:
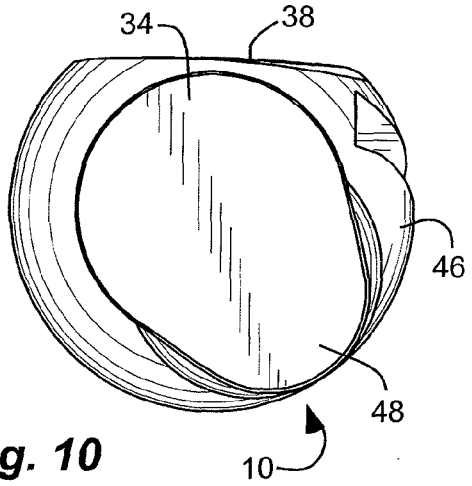
FIG. 10 is a bottom view of the combined passive acoustic speaker and stand device of FIG. 1.
Figure 11:
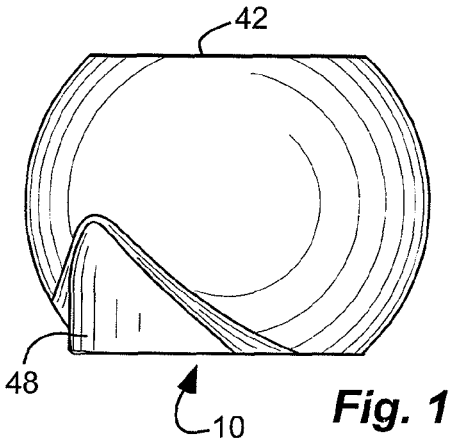
FIG. 11 is a rear view of the combined passive acoustic speaker and stand device of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The terms "passive" and "acoustic" are used separately or combined to refer to an amplifier that amplifies sound in an acoustic manner without additional power. The terms "passive acoustic speaker" and "amplifier" are used interchangeably herein to refer to a passive and/or acoustic amplifier that amplifies sound from a speaker without the need for external or additional power.

The term "speaker" is used broadly herein to refer to a sound generator, including for example, a speaker or sound transducer, or the like.

The terms "electronic device" and "portable, handheld electronic device" are used interchangeably herein, and broadly to refer to an electronic device carried by individuals, such as communication devices or video devices, with one or more speakers or transducers, including by way of example, a cellular phone or smart phone (e.g. iPhone); a tablet computer (iPad®, Galaxy®, or the like); an MP3 player (iPod® or the like) or other digital music player; a gaming device or console (Nintendo® DS, PSP®, iPod or iPad, or the like); a camera; a global positioning system (GPS) system; a personal digital assistant (PDA); a radio; a two-way radio; a citizens band radio; a walkie-talkie; a video recorder; a cassette player and/or recorder; a mini-cassette recorder; a video disc DVD or Blueray player; a portable television; a digital camera; a video camera; a portable computer (laptop computer, iPad®, or the like); a radar detector; an e-book or e-reader (Kindle®, Nook®, iPad®, Sony Reader™, or the like); a portable television (TV); a portable media player (iPad® and iPod® and the like) for playing music and video, and running software applications such as games and utilities; combinations thereof; etc. The portable, handheld electronic device can be mobile and transportable. The portable, handheld electronic device can be carried by a user, such as in a pocket or purse, and also can be held in the user's hand(s). The portable, handheld electronic device can also be deployed on a support surface, such as removed from a pocket or purse, and from the user's hand. Such devices often have a display screen or liquid crystal display (LCD) which the user desires to view. Such devices can often be used to display information or images for prolonged periods, such as video, text, etc. Such devices can have a display or screen that is oblong or rectangular, or longer or wider in one direction than another. Such displays or screen can be capable of providing information or images in portrait, landscape or both.

The term "portrait" is used herein to refer to an orientation in which the height is greater than the width; while the term "landscape" is used herein to refer to an orientation in which the width is greater than the height.

The term "support surface" is used broadly herein to refer to a surface, most often horizontal, upon which a portable electronic device can be placed, including for example, a table top, desk top, counter top, shelf, or the like.

The term "indicia" is used broadly herein to refer to markings such as words, sentences, symbols, pictures, icons, colors, etc. In one aspect, the indicia, or words, sentences, symbols, pictures, or colors thereof, can represent or present logos, slogans, trademarks, service marks, etc. In one aspect, the indicia can be provided in a manner that is visually and/or tactily discernible and distinguishable by a user or viewer, such as by printing, embossing, debossing, etc. In one aspect, the indicia can be indicative of or representative of a business or company or organization, or a product or service, or both.

The terms "business" and "company" are used broadly herein to refer to an organization that provides a product or a service. The business, company or organization can have a name, logo, slogan, trademark, service mark, etc. that is capable of identifying and/or distinguishing the business or company, or product or service, or both, or can otherwise be utilized to market, promote, and/or brand the business or company, or product or service, or both.

The logo or indicia can be or can include letters, symbols, figures, pictures, logos, art, corporate messages, slogans, bilines, icons, etc. that are associated with or that form a representation of a business or product. The logo or indicia can be raised in, indented into, or both, the lid, or with respect to the outer surface of the lid.

DESCRIPTION

As illustrated in FIGS. 1-17, a combined passive acoustic speaker/amplifier and stand, indicated generally at 10, in an example implementation in accordance with the invention is shown supporting and amplifying a portable, handheld electronic device 14, for example a cellular or smart phone. The portable, handheld electronic device 14 can have a screen for displaying information and/or visual images, such as video, and a speaker for transmitting audio, such as the sound associated with the visual image or video. The speaker can be disposed in or face or emit from a side edge of the portable, handheld electronic device. A cellular or smart phone is an example of one field that can benefit from the present invention. The amplifier and stand 10 can both support the phone on a support surface 18 (FIG. 13) at an inclined angle for improved viewing, and amplify the sound from the speaker without the need for power. The amplifier and stand 10 can support the phone or portable, handheld electronic device at a viewing angle while maintaining the phone or portable, handheld electronic device on a support surface without elevating or otherwise coming between the support surface and the phone or portable, handheld electronic device for increased stability. In addition, the amplifier and stand 10 can further provide a surface for indicia 22, such as advertising and/or logos.

The passive acoustic speaker/amplifier and stand 10 includes a block 26 having a hollow therein. The block 26 can be of any size and/or shape, and can be formed of any material, including for example, silicon. In one aspect, the block 26 can be rigid. In another example, the block can be flexible and resilient so that it is compressible but elastic to return to its original shape. The block can be injection molded in one or more pieces. The block 26 can have a bottom 34 disposable on the support surface 18, a front 38 facing forward, a top 42 facing upward, and a side 46 facing laterally with respect to the front. The bottom 34 of the block can have a flat surface. The side 46 can be between the bottom 34 and the top 42 of the block. In one aspect, the block can have an arcuate or indented bottom rear edge to reduce material use; and a stabilizing foot 48 extending from the bottom and/or the rear, with a bottom flush with the bottom of the block, to resist tipping of the block.

An inclined slot 50 is disposed in or formed in the side 46 of the block 26. The slot 50 is oriented at an acute angle with respect to the bottom 34 of the block and/or the support surface 18 (or horizontal). In one aspect, the slot 50 can be oriented between 40 and 80 degrees with respect to the bottom. In another aspect, the slot 50 can be oriented between 50 and 70 degrees with respect to the bottom. In another aspect, the slot 50 can be oriented between 55 and 65 degrees with respect to the bottom. In another aspect, the slot 50 can be oriented at 60 degrees with respect to the bottom.

The slot 50 can have a slot bottom 54 or inner base and slot sides 58 forming an elongated channel in the side 46 of the block. The slot 50 removably receives and retains a portion of the portable, handheld electronic device 14 therein. The acute inclined angle of the slot orients the electronic device, and screen thereof, at the same acute angle with respect to the support surface. The slot 50 can have a slot width between the slot sides sized to receive the electronic device with a press or interference fit so that the electronic device is retained by friction. As stated above, the block 26, and thus the side 46 thereof and the slot sides 58, can be formed of a flexible material, such as plastic or silicon, that can deflect outwardly when the electronic device is inserted, and that is elastic to pinch or grip the electronic device therein. In addition, the slot sides 58 can be tapered, or can have a narrower upper or outer opening and a wider bottom or inner base (see FIG. 17), to accommodate electronic devices of differing width, or with cases or films thereon. As described above, the block 26 and thus the slot sides 58, can be flexible and resilient to bend or deflect outwardly to accommodate thicker electronic devices, and resilient and/or elastic to grip.

Furthermore, the slot 50 can have an open end 66 adjacent to and/or facing towards the bottom 34 or the support surface 18 so that the electronic device 14 can extend out of the slot to rest on the support surface. Thus, both the block 26 and the portable, handheld electronic device 14 can rest on the support surface 18 when the portable, handheld electronic device is inserted into the slot with a side edge 70 of the portable, handheld electronic device contacting the support surface along an entire length of the side edge. Thus, the electronic device is not perched atop the amplifier and stand device, or angled off of it, in an unstable manner.

An aperture 74 is disposed in or formed in the bottom 54 of the slot 50, and extends through the side of the block and into the hollow therein. The aperture 64 is aligned with the speaker of the portable, handheld electronic device 14 when inserted into the slot. Thus, the speaker is in fluid or acoustic communication with the hollow of the block through the side of the block.

Figure 12:
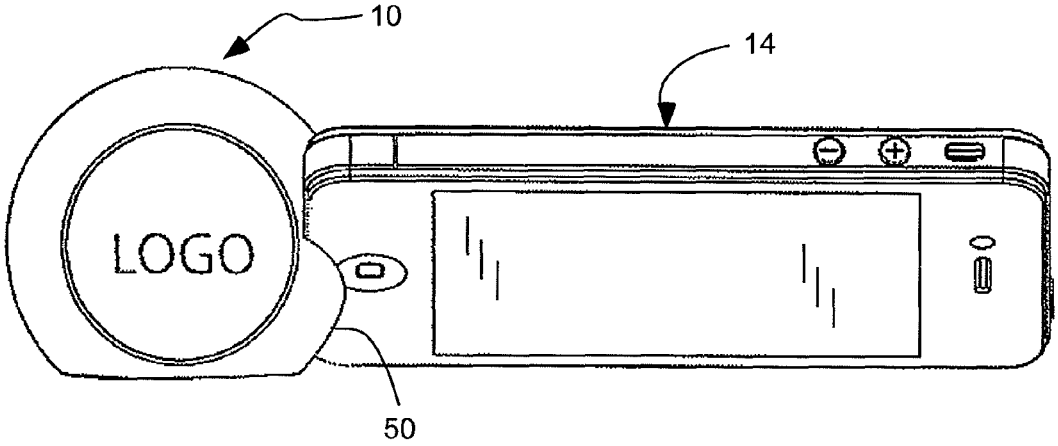
FIG. 12 is a top view of the combined passive acoustic speaker and stand device of FIG. 1 shown supporting and amplifying the portable, handheld electronic device.
Figure 13:
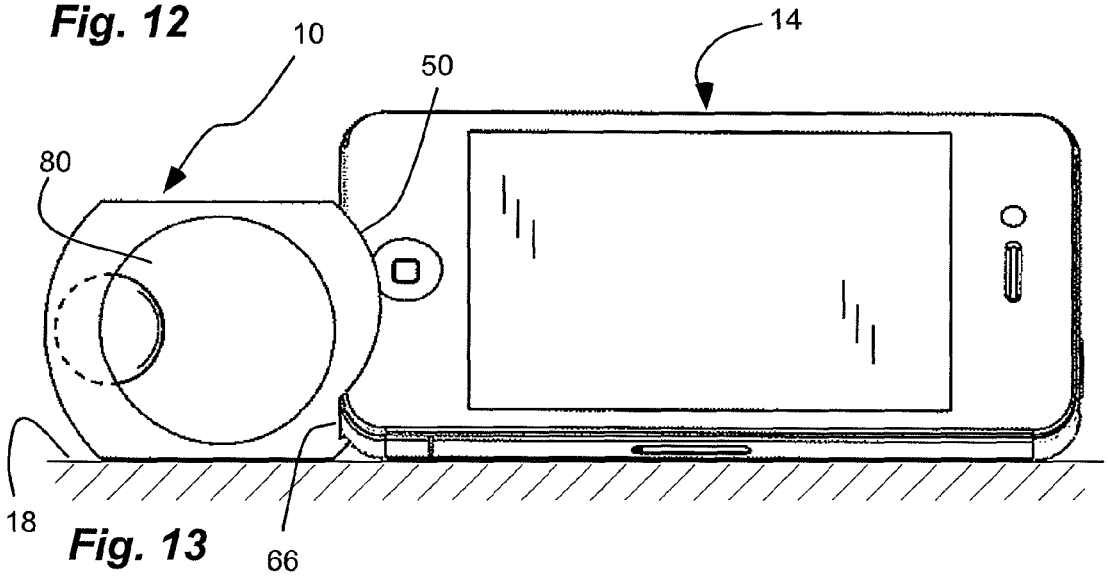
FIG. 13 is a front view of the combined passive acoustic speaker and stand device of FIG. 1 shown supporting and amplifying the portable, handheld electronic device.
Figure 14:
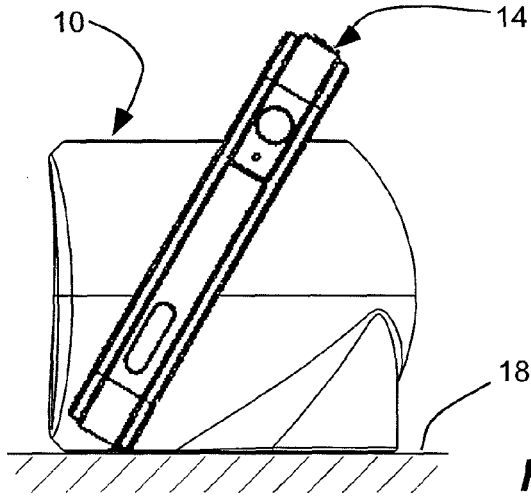
FIG. 14 is a side view of the combined passive acoustic speaker and stand device of FIG. 1 shown supporting and amplifying the portable, handheld electronic device.
Figure 15:
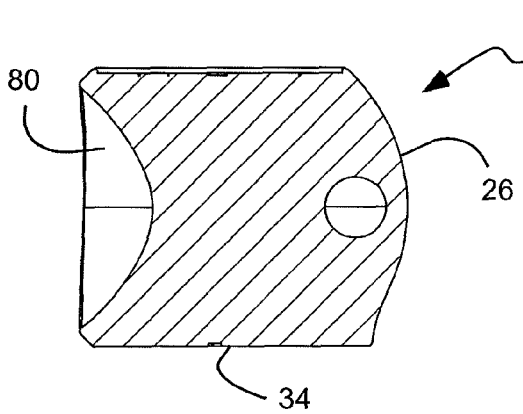
FIG. 15 is a cross-sectional side view of the combined passive acoustic speaker and stand device of FIG. 1, taken along line 15 in FIG. 3.
Figure 16:
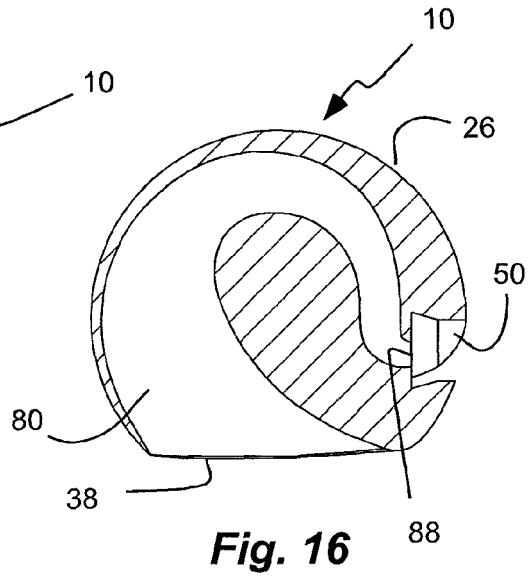
FIG. 16 is a cross-sectional top view of the combined passive acoustic speaker and stand device of FIG. 1, taken along line 16 in FIG. 3.
Figure 17:
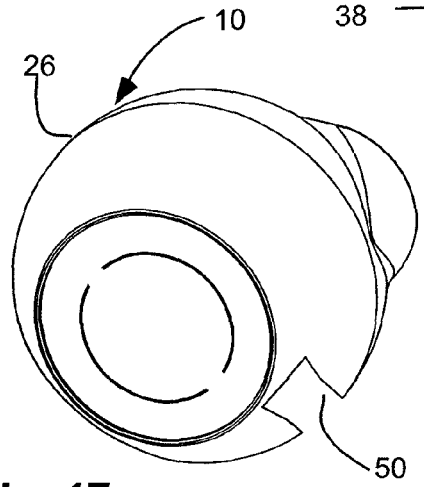
FIG. 17 is a top perspective view of the combined passive acoustic speaker and stand device of FIG. 1.

The block 26 can have a horizontal depth from the front to a rear thereof greater than a depth of the portable, handheld electronic device 14 when inserted into the slot 50, as shown in FIG. 13; and the block 26 can have a height from the bottom to the top thereof less than a height of the portable, handheld electronic device 14 when inserted into the slot, as shown in FIGS. 12 and 13. Thus, the block 26 or amplifier and stand 10 can be large enough to support the electronic device 10, but small enough to be portable. With a speaker disposed in a bottom of the electronic device 14 and the aperture 74 and the slot 50 disposed in the lateral side 46 of the block 26, the amplifier and stand device 10 and/or the block 26 can orient the electronic device in the landscape orientation. Thus, the amplifier and stand device 10 and/or the block 26 and the electronic device 14 can be disposed in a laterally adjacent, or side-by-side, relationship.

The hollow can include or can be a non-symmetrical (in one direction although it can be symmetrical in another direction, such as about a horizontal plane), arcuate-axis, frusto-conical horn 80 formed in the block 16. The horn 80 has a larger forward sound outlet opening 84 in the front 38 of the block. The outlet opening 84 can be formed in the front 38 of the block and can be flush therewith. The outlet opening can occupy substantially all of the front of the block to maximize amplification and efficiently utilize the physical volume of the block. In addition, the horn 80 has a smaller rearward sound inlet opening 88 in a rear of the horn, and open to the aperture 74 in the bottom of the slot. The smaller rearward sound inlet opening 88 in a rear of the horn can be directly coupled to the aperture 74 and/or the slot. The horn or an intermediate portion thereof can bend or curve away from the slot and towards the opposite lateral side 92 of the block, opposite the side 46 with the slot therein, and towards the rear of the block. The horn or axis thereof can follow a serpentine path through the block. The horn can form or can define the hollow of the block. The hollow or horn can have a different shape than the block. Thus, the block can be shaped to hold and support the portable, handheld electronic device, while the horn or hollow can be shaped to amplify sound.

The amplifier and stand device 10 and/or the block 26 can include indicia 22 thereon, such as on the top 42 and/or facing upwardly. As described above, the indica 22 can represent or present logos, slogans, trademarks, service marks, etc. In one aspect, the indicia can be indicative of or representative of a business or company, or a product or service, or both. The indicia can be provided in a manner that is visually and/or tactily discernible and distinguishable by a user or viewer. Thus, the amplifier and stand device 10 can be used as a promotional device.

Figure 18:
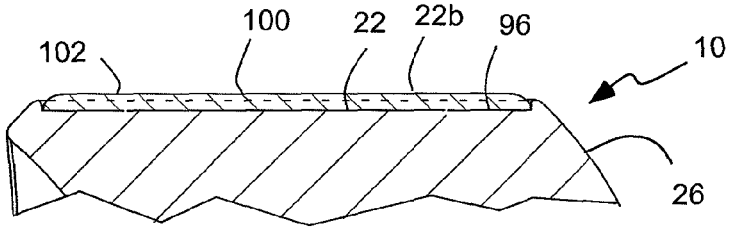
FIG. 18 is a partial cross-sectional side view of the combined passive acoustic speaker and stand device of FIG. 1.
Figure 19:
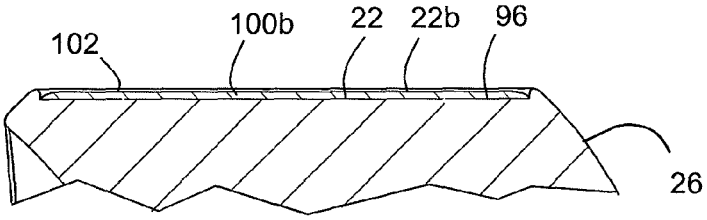
FIG. 19 is a partial cross-sectional side view of another combined passive acoustic speaker and stand device in accordance with another embodiment of the invention.

The top 42 of the block 26 can also have an upper indentation 96 that receives an insert 100 disposed therein. In one aspect, the insert 100 can have an upper surface 102 extending above the block and forming the top or uppermost surface of the device 10, so that the indicia 22 is visible, as shown in FIG. 18. The bottom 34 of the block 26 and the top surface 102 of the insert 100 can be parallel so that the top surface of the insert faces upwardly. The insert 100 can be fixed in the indentation 96, such as by permanent or releasable adhesion. A perimeter wall of the top can circumscribe the indentation 96 and the insert 100. In one aspect, the insert 100 can carry the indicia 22. For example, the indicia 22*b* can be formed on the top surface 102 of the insert for visibility. As another example, the indicia 22 can be disposed on a bottom surface of the insert 100, and the insert can be transparent, or at least translucent, so that the indicia 22 is visible through the insert 100. Thus, the insert 100 can protect the indicia 22. In another aspect, the indicia 22 can be carried on the block 26 on the top of the indentation 96, under the insert 100, and visible therethrough. In another aspect, the upper surface 102 of the insert 100*b* can be recessed in the upper indentation 96 to protect the indicia and/or insert, as shown in FIG. 19.

In one aspect, the insert 100 can be or can include a squat dome formed by polyurethane. The dome can be adhered within the indentation with an adhesive film. The insert or dome can have a broad, flat, squat shape with an upward facing or outward facing or outfacing surface. A majority, or essentially all, of the outward facing surface can be continuous and smooth and parallel with the bottom. In addition, the outward facing surface can be flat or substantially flat. Furthermore, the outward facing surface can be surrounded by a radius perimeter. Thus, the perimeter of the outward facing surface curves toward the block. In one aspect, all of the outward facing surface can be flat and smooth and continuous between the radiused perimeter. The dome and/or outward facing surface can be tacky to cling to an item or device, such as by mechanical or specific adhesion. Furthermore, the dome can be substantially transparent, or at least translucent, so that the block or indicia thereon can be visible through the dome. The dome can be formed of polyurethane.

The insert 100 can include an adhesive film adhered to the block 14. The adhesive film can use a chemical adhesive to adhere. The adhesive can be selected to provide sufficient adhesion between the insert and the block without separating. The adhesive can also be selected so that the insert can be removed if desired. Thus, the adhesive film can include a releasable adhesive, as opposed to a permanent adhesive. The adhesive film can be a repositionable adhesive film releasably and repositionably adhered to the insert or the block. The adhesive film can have an adhesive bond between the insert and the block. The adhesive film also has a contact surface between the adhesive film or the insert and the block. Furthermore, the adhesive and/or the adhesive film can be substantially transparent, or at least translucent, so that the surface of the block or indicia can be visible through the insert and the film. The adhesive and/or adhesive layer can be a removable 3M Controltac™ adhesive.

The adhesive film can be disposed on a substrate. The substrate can also be a film. In one aspect, the substrate can be substantially non-absorbent. The substrate can provide a surface, such as an upper or inner surface opposite the adhesive that can be printable. In addition, the substrate can be substantially transparent, or at least translucent, so that the surface of the device can be visible through the insert. The substrate can be a printed 3M Graphics Vinyl. Alternatively, the substrate can be a polyester film. The substrate can be any laminated (non-porous) substrate, including: PP, PVC, PET, ABS, polyester, regular sticker paper, vinyl, or tin metal (foil). Alternatively, the substrate can have be other films with other characteristics, such as reflective, metal shine, textured, etc.

A dome can be affixed to the adhesive film and/or substrate, and adhered to the block by the adhesive film. The dome can be secured to the adhesive film and/or substrate. A graphic layer can be disposed between the adhesive film and the dome, or between the substrate and the dome. The graphic layer can include ink disposed on or printed on the substrate. For example, the graphic layer can be an aqueous based inkjet ink. The graphic layer can include the indicia. In addition, the graphic layer can include directions for use, orientation, care, etc. Furthermore, the graphic layer can be or can include other inclusions. The graphic layer can be visible through the dome. The graphic layer and/or inclusion can be smaller or can have a smaller size than the substrate and dome such that the graphic layer and inclusion are surrounded by a perimeter of the dome and substrate.

As indicated above, the graphic layer can be or can include an inclusion. The inclusions can be embedded in the dome. For example, the graphic layer can be an etched metallic layer. The metallic layer can be etched to form the indicia. Other inclusions can be an LED (or other light source) and a battery power source; a hologram or lenticular artwork; an RFID computer chip or tag; a mirror; one or more gems or faux gems; etc. The LED may remain continuously activated or lit. Alternatively, the LED may be activated, or the leads for the LED selectively contacted by the battery, such as by pressure applied to the pad. Alternatively, a light sensor can be electrically coupled between the battery and the LED to activate the LED in low light conditions. Other electronics can be included for special effects, such as flashing, etc. It will be appreciated that multiple lights or LEDs of one or more color can be included or embedded in the dome. As another example, a gem or faux gem can be embedded in the dome. The inclusion(s) can be disposed on the adhesive film and/or substrate, and surrounded by the material of the dome so that the inclusion projects into the dome. Thus, the inclusions can be inclusions for the dome and/or the graphics layer.

The dome can also include inclusions embedded therein. For example, the dome can include a scented material, such as a scented oil, that is permeable through the polyurethane material of the dome. In addition, the dome can be colored and translucent. Furthermore, the dome can include a florescent material.

In another aspect, the insert can have an opaque dome with a graphic layer, such as printing, on the outfacing surface. The opaque dome can have a color to match or complement the block.

A method for using the combined passive acoustic speaker and stand device 10 described above includes inserting the portion of the portable, handheld electronic device 14 in the inclined slot 50; orienting the portable, handheld electronic device 14 at an acute inclined angle with respect to the support surface 18; disposing the portable, handheld electronic device 14 and the combined passive acoustic speaker and stand device 10 on the support surface 18; and removing the portable, handheld electronic device 14 from the combined passive acoustic speaker and stand device 10.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A combined passive acoustic speaker and stand device configured for a portable, handheld electronic device, the combined passive acoustic speaker and stand device comprising:

a) a block having a hollow therein, a bottom disposable on a support surface, a front facing forward, a top facing upward, and a side facing laterally with respect to the front;

b) an inclined slot in the side oriented at an acute angle with respect to the bottom and having a slot bottom and slot sides forming an elongated channel in the side of the block configured to receive and releasably retain a portion of the portable, handheld electronic device therein at an acute inclined angle with respect to the support surface;

c) an aperture in the bottom of the slot extending through the side of the block and into the hollow therein, the aperture located to align with a speaker of the portable, handheld electronic device when inserted into the slot; and d) the hollow shaped as a non-symmetrical, arcuate-axis, frusto-conical horn with a larger forward sound outlet opening in the front of the block and a smaller rearward sound inlet opening in a rear of the horn and open to the aperture in the bottom of the slot.

2. A device in accordance with claim 1, further comprising:

a) an upper indentation in the top of the block;

b) an insert disposed in the upper indentation with an upper surface extending above the block; and c) indicia carried by the insert or the block at the indentation.

3. A device in accordance with claim 2, wherein the bottom of the block and the top surface of the insert are parallel.

4. A device in accordance with claim 1, further comprising: the slot sides being formed of a flexible and resilient material capable of deflecting outwardly configured to grip the portable, handheld electronic device.

5. A device in accordance with claim 4, further comprising: the slot sides being tapered and the channel having a narrower outer opening and a wider bottom.

6. A device in accordance with claim 1, wherein the block has a depth from the front to a rear thereof greater than a depth of the portable, handheld electronic device when inserted into the slot; and wherein the block has a height from the bottom to the top thereof less than a height of the portable, handheld electronic device when inserted into the slot.

7. A device in accordance with claim 1, wherein the bottom of the block has a flat surface and the side with the inclined slot is between the bottom and the top of the hollow block.

8. A device in accordance with claim 1, wherein the slot has an open end.

9. A device in accordance with claim 1, wherein the slot is oriented between 50 and 70 degrees with respect to horizontal.

10. A device in accordance with claim 1 in combination with the portable, handheld electronic device with the portion of the portable, handheld electronic device in the inclined slot and oriented at an acute inclined angle with respect to the support surface, and with the speaker of the portable, handheld electronic device aligned with the aperture in the bottom of the slot.

11. A device in accordance with claim 10, wherein the block and the portable, handheld electronic device both rest on the support surface when the portable, handheld electronic device is inserted into the slot, with a side edge of the portable, handheld electronic device contacting the support surface along an entire length of the side edge.

12. A method for using the combined passive acoustic speaker and stand device of claim 1, comprising:

a) inserting the portion of the portable, handheld electronic device in the inclined slot;

b) orienting the portable, handheld electronic device at an acute inclined angle with respect to the support surface;

c) disposing the portable, handheld electronic device and the combined passive acoustic speaker and stand device on the support surface; and d) removing the portable, handheld electronic device from the combined passive acoustic speaker and stand device.

13. A combined passive acoustic speaker and stand device in combination with a portable, handheld electronic device with a speaker in an edge thereof, the combined passive acoustic speaker and stand device comprising:

a) a block having a hollow therein, a bottom disposable on a support surface, a front facing forward, a top facing upward, and a side facing laterally with respect to the front;

b) an inclined slot in the side oriented at an acute angle with respect to the bottom and having a slot bottom and slot sides forming an elongated channel in the side of the block removably receiving and retaining a portion of the portable, handheld electronic device therein at an acute inclined angle with respect to the support surface;

c) an aperture in the bottom of the slot extending through the side of the block and into the hollow therein, the aperture aligned with the speaker of the portable, handheld electronic device when inserted into the slot;

d) the hollow including a non-symmetrical, arcuate-axis, frusto-conical horn with a larger forward sound outlet opening in the front of the block and a smaller rearward sound inlet opening in a rear of the horn and open to the aperture in the bottom of the slot;

e) an upper indentation in the top of the block;

f) an insert disposed in the upper indentation with an upper surface extending above the block; and g) indicia carried by the insert or the block at the indentation.

14. A device in accordance with claim 13, wherein the block has a depth from the front to a rear thereof greater than a depth of the portable, handheld electronic device when inserted into the slot; and wherein the block has a height from the bottom to the top thereof less than a height of the portable, handheld electronic device when inserted into the slot.

15. A device in accordance with claim 13, wherein the block and the portable, handheld electronic device both rest on the support surface when the portable, handheld electronic device is inserted into the slot with a side edge of the portable, handheld electronic device contacting the support surface along an entire length of the side edge.

16. A device in accordance with claim 13, wherein the bottom of the block and the top surface of the insert are parallel.

17. A device in accordance with claim 13, wherein the bottom of the block has a flat surface and the side with the inclined slot is between the bottom and the top of the hollow block.

18. A device in accordance with claim 13, wherein the slot has an open end.

19. A device in accordance with claim 13, wherein the slot is oriented between 50 and 70 degrees with respect to horizontal.

20. A method for using the combined passive acoustic speaker and stand device of claim 13, comprising:

a) inserting the portion of the portable, handheld electronic device in the inclined slot b) orienting the portable, handheld electronic device at an acute inclined angle with respect to the support surface;

c) disposing the portable, handheld electronic device and the combined passive acoustic speaker and stand device on the support surface; and d) removing the portable, handheld electronic device from the combined passive acoustic speaker and stand device.

21. A combined passive acoustic speaker and stand device in combination with a portable, handheld electronic device with a speaker in an edge thereof, the combined passive acoustic speaker and stand device comprising:

a) a block having a hollow therein, a bottom disposable on a support surface, a front facing forward, a top facing upward, and a side facing laterally with respect to the front;

b) an inclined slot in the side oriented at an acute angle between 50 and 70 degrees with respect to the bottom and having a slot bottom and slot sides forming an elongated channel in the side of the block removably receiving and retaining a portion of the portable, handheld electronic device therein at the acute inclined angle with respect to the support surface, the slot having an open end with the block and the portable, handheld electronic device both resting on the support surface when the portable, handheld electronic device is inserted into the slot with a side edge of the portable, handheld electronic device contacting the support surface along an entire length of the side edge;

c) the slot sides being formed of a flexible and resilient material capable of deflecting outwardly to grip the portable, handheld electronic device, and the slot sides being tapered and the channel having a narrower outer opening and a wider bottom;

d) an aperture in the bottom of the slot extending through the side of the block and into the hollow therein, the aperture aligned with the speaker of the portable, handheld electronic device when inserted into the slot;

e) the hollow including a non-symmetrical, arcuate-axis, frusto-conical horn with a larger forward sound outlet opening in the front of the block and a smaller rearward sound inlet opening in a rear of the horn and open to the aperture in the bottom of the slot;

f) an upper indentation in the top of the block;

g) an insert disposed in the upper indentation with an upper surface extending above the block; and h) indicia carried by the insert or the block at the indentation.

* * * * *